United States Patent [19]

Snyder

[11] Patent Number: 4,725,801

[45] Date of Patent: Feb. 16, 1988

[54] BISTABLE SOLENOID SWITCH

[75] Inventor: John L. Snyder, Logansport, Ind.

[73] Assignee: Hamilton Standard Controls, Inc., Farmington, Conn.

[21] Appl. No.: 922,977

[22] Filed: Oct. 24, 1986

[51] Int. Cl.[4] ..... H01H 67/02; H01H 67/06

[52] U.S. Cl. ..... 335/125; 335/122; 335/126; 335/190

[58] Field of Search ..... 335/260–264, 335/122–127, 185–192, 128, 78, 90

[56] References Cited

U.S. PATENT DOCUMENTS

| | | | |
|---|---|---|---|
| 820,119 | 5/1906 | Kitt . | |
| 1,824,973 | 9/1931 | Wescott . | |
| 1,908,567 | 5/1933 | Steinmayer . | |
| 2,528,520 | 11/1950 | Jackson et al. . | |
| 2,703,348 | 3/1955 | Knapp et al. . | |
| 2,721,904 | 10/1955 | Souter | 335/125 |
| 2,827,530 | 3/1958 | Sauer | 335/125 |
| 2,851,646 | 9/1958 | Williamson et al. . | |
| 2,874,244 | 2/1959 | Hamblett et al. . | |
| 2,892,059 | 6/1959 | Keirans . | |
| 2,922,861 | 1/1960 | White . | |
| 3,401,892 | 9/1968 | Meyers . | |

*Primary Examiner*—E. A. Goldberg
*Assistant Examiner*—Lincoln Donovan
*Attorney, Agent, or Firm*—Stephen A. Schneeberger

[57] ABSTRACT

A bistable solenoid switch has a plunger and associated movable contact adapted for controlled reciprocation by a coil and bobbin assembly to either of two stable states not requiring sustained energization of the coil. The movable contact is biased toward one of the stable states, for example, "Contacts Closed" in which a pair of stationary contacts are engged by the movable contact. The bobbin is provided with one or more radial projections extending into its core for serving a detenting function with respect to a land formed on an end face of the plunger. When the bobbin projection is engaged by the plunger land, it is prevented from displacing the movable contact into engagement with the stationary contact, and the second, or "Contacts Open", state exists. Means are also provided for translating axial displacement of the plunger into angular displacement for moving it into and out of the detented engagement with the bobbin projection. The displacement translating means may include camming arrangements involving the plunger, the bobbin projection and a third member.

16 Claims, 8 Drawing Figures

*( CONTACTS CLOSED )*

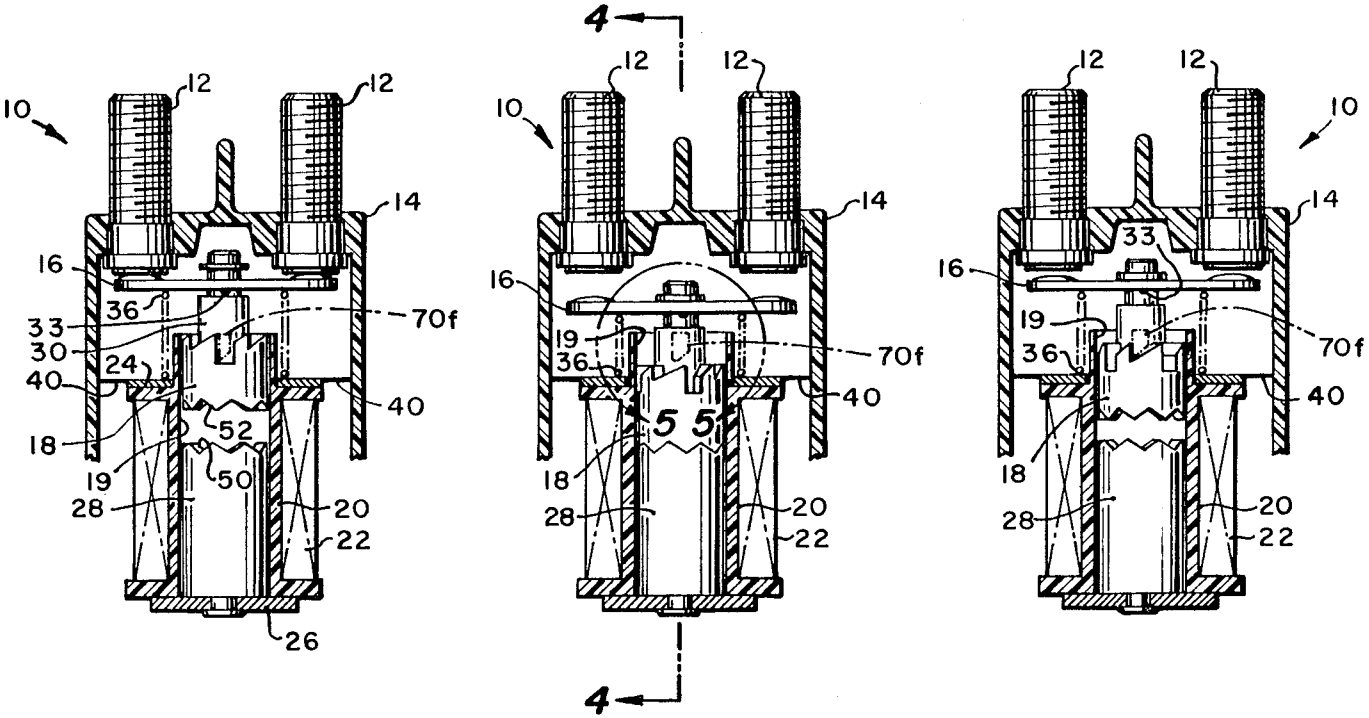
FIG. 1 (CONTACTS CLOSED)
FIG. 2 (COIL ENERGIZED)
FIG. 3 (CONTACTS OPEN)

(CONTACTS CLOSED)

(COIL ENERGIZED)

(CONTACTS OPEN)

BISTABLE SOLENOID SWITCH

TECHNICAL FIELD

The present invention relates to an electromagnetically-actuated switch and, more particularly, relates to a bistable solenoid switch.

BACKGROUND ART

Electromagnetically actuated switches exist in a variety of forms and for a variety of functions. Typically, they serve the function of opening and closing electrical circuits by controlling the bridging of a pair of contacts by a movable conductor. That conductor forms part of, or is carried by, an armature, the displacement of which is controlled by the selective energization of an electrical coil. In most such instances, the coil remains energized to maintain the contacts in one of their operative states, either open or closed. However, in many other instances, it may be necessary or at least desirable to maintain the associated switching circuitry in each of its stable states without requiring continued energization of the coil.

Exemplary of one type of the latter mentioned class of electromagnetic switches are U.S. Pat. Nos. 820,119; 1,824,973; 2,528,520; 2,851,646; 2,892,059; and 3,401,892. Each of these patents depicts an electromagnetic switch in which a linearly-moving armature or plunger is caused to rotate as a result of linear reciprocation. Such rotation is operative to move a bridging conductor between successive, angularly-displaced contacts, typically for some form of sequential control.

Exemplary of another type of electromagnetic switches of the class described earlier are U.S. Pat. Nos. 1,908,567; 2,703,348; 2,874,244; and 2,922,861. These electromagnetic switches are typically concerned with simply moving the contact-bridging element between either one of two stable states, e.g. "Contacts Closed" or "Contacts Open". Apart from the brief application of an actuating potential to the coil for moving the contact-bridging structure between its two stable states, no further energization of the coil is required. Such switches have, in some instances, been characterized as bistable relays or solenoids and will be so characterized herein. Typically, these electromagnetic switches are of a solenoid configuration in which an armature or plunger is reciprocated axially of an annular coil. Moreover, some portion of the plunger is usually axially coextensive with the coil during some portion of operation. In such bistable solenoid switches, it has been relatively common to effect the requisite bistable operation by means of a pin-and-slot arrangement. A pin, carried by the plunger, is subjected to the camming action of a stationary slot during axial displacement to provide the requisite rotational control of the plunger. U.S. Pat. Nos. 1,908,567; 2,874,244; and 2,922,861 are of that type. In another configuration represented by the aforementioned U.S. Pat. No. 2,703,348, the pin may be stationary and the slot may be formed in the plunger. The pin extends radially inward from the coil and into the slot.

The provision of such pin-and-slot arrangement to obtain a bistable solenoid switch complicates the manufacturing process and thereby increases its cost. Moreover, the integrity of the resulting system may, in some respects, be compromised. Certainly the assembly of the pin-and-slot structure in the aforementioned U.S. Pat. No. 2,703,348 patent presents a significant challenge.

DISCLOSURE OF THE INVENTION

Accordingly, it is a principal object of the invention to provide an improved electromagnetic switch, particularly of the bistable solenoid type, which is relatively simple and inexpensive to manufacture. Included within this object is the provision of such a device having long term integrity and durability.

It is a further object to provide an improved bistable solenoid switch of the type in which a contact-bridging structure is mounted on and carried by the plunger for directly closing the contacts.

According to the invention, there is provided an improved solenoid-operated bistable switch of the type having at least two contacts, a coil assembly fixedly positioned relative to the two contacts and including a bobbin having an axial bore and a coil disposed on the bobbin, a plunger disposed at least partly in the bore of the bobbin for rotation and axial reciprocation relative to the bobbin, conductive contact-bridging means mounted on the plunger for reciprocation therewith between at least two positions respectively in and out of contact-bridging engagement with the two contacts, the contact-bridging means being biased toward one of the at least two positions, and the coil being selectively energizable to overcome the bias for displacing the plunger and contact-bridging means. The improved construction includes means for translating axial displacement of the plunger into rotation of the plunger relative to the bobbin, the plunger having a first end face which faces in the direction toward which the contact-bridging means is biased, and detent means cooperatively including radial projection means on the bobbin and first land means of less than 360° extent on the first end face of the plunger. The detent means prevents displacement of the plunger and contact-bridging means entirely to the position toward which they are biased following termination of energization of the coil when the first land means is angularly in registry with the projection means.

The detent means and the axial-to-rotary displacement translation means are cooperatively structured to provide the registry between the first land means and the projection means following alternate terminations of energization of the coil. There are first and second axial-to-rotary displacement translation means for providing the rotation of the plunger upon its axial displacement in respectively opposite directions. The first axial-to-rotary displacement translation means comprises the plunger first end face having at least one cam surface positioned for axial engagement with the bobbin projection and contoured to impart relative angular displacemennt to the plunger when moved axially toward one another. The second axial-to-rotary displacement translation means comprises a plunger second end face disposed oppositely of the plunger first end face and a fixed stop member in axial alignment with the plunger second end face, the stop member and the plunger second end face being configured to provide a complementary cam surface and follower. That stop member and plunger second end face include respective circular arrays of triangular teeth in facing relation to thereby provide the complementary cam surface and follower.

The first axial-to-rotary displacement translation means more specifically comprises the plunger first end face having first and second cam surfaces in angular-sequential relation, the bobbin projection alternately engaging and moving along the first end second cam surfaces following respectively alternate terminations of energization of the coil. The first cam surface has a leading and a trailing end and the first land means is proximate that trailing end. The plunger first end face further includes second land means angularly spaced from the first land means. The second cam surface has a leading and a trailing end, and the second land means is proximate that trailing end. The second land means is so positioned axially of the plunger that displacement of the plunger and contact-bridging means to the position toward which they are biased is permitted when the second land means is rotated into registry with the bobbin projection means.

The first and second cam surfaces are inclined in the same general direction to effect unidirectional rotation of the plunger. The first cam surface and the first land means comprise a single first inclined plane, and the second cam surface and the second land means comprise, in combination, a second inclined plane and a stepped notch extending axially inward of the plunger.

The contact-bridging means is mounted on the plunger in a manner allowing limited axial displacement relative thereto. A biasing spring acts directly on the contact-bridging means for urging it toward one of the limit positions, typically that position in which it engages the two contacts.

The bobbin is typically plastic and the radial projection means, typically being two projections, is integrally molded therewith and extends into the bore of the bobbin. Each projection includes an inclined planar surface which may be substantially parallel to or steeper than the first and second incline planes of the first and second cam surfaces on the first end face of the plunger.

BRIEF DESCRIPTION OF THE DRAWINGS

FIG. 1 is a fragmentary longitudinal view, partly broken away and partly in section, of a bistable solenoid switch according to the invention and illustrating a "Contacts Closed" condition;

FIG. 2 depicts the bistable solenoid switch in the solenoid coil "Energized" position;

FIG. 3 depicts the bistable solenoid switch in the "Contacts Open" position;

BEST MODE FOR CARRYING OUT THE INVENTION

Figure 5:
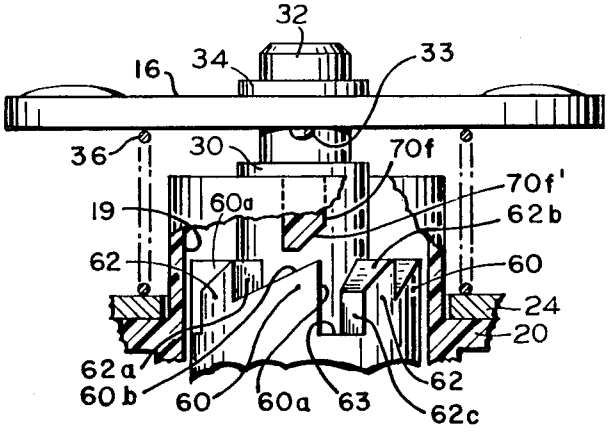
FIG. 5 is an enlarged view taken along line 5—5 of FIG. 2.
Figure 4:
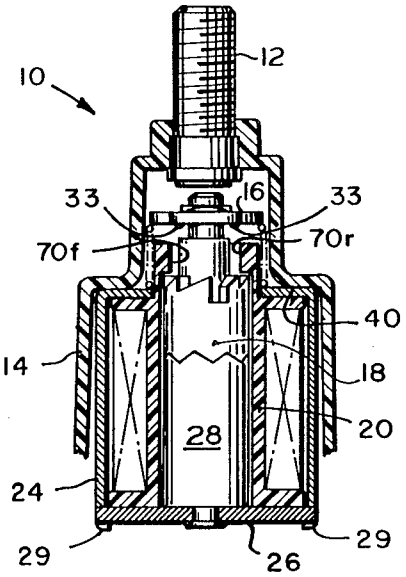
FIG. 4 is a sectional view of the bistable solenoid switch of FIG. 2 taken along line 4—4 thereof.

Referring to the Figures, there is illustrated a bistable solenoid switch 10 in accordance with the invention. A pair of stationary contacts 12 are suitably mounted in a housing 14, only a portion of which is shown. The contacts 12 extend through an end wall of the housing 14 for connection with external circuitry, those contacts being selectively electrically connectable to or disconnectable from one another at their interior ends by means of a contact-bridging member, such as movable contact 16. Movable contact 16 is supported and displaced by solenoid plunger 18. Plunger 18 is part of the solenoid which additionally includes a coil assembly having a bobbin 20 and a selectively energizable electrical coil 22 on the bobbin. The coil assembly typically also includes a magnetic frame 24 and magnetic base plate 26 which embrace the bobbin 20 to provide a flux path in a known manner. The magnetic frame 24 is generally of an inverted U-shape with a circular opening through its connecting portion for receiving one end of the bobbin 20. Deformable locking tabs 29 are provided at the ends of the arms of the frame 24 for retainably engaging the magnetic base plate 26. A stop member 28 is also provided in axial alignment with the plunger 18 and is conveniently fixedly mounted on the base plate 26 and extends within the bore 19 of bobbin 20.

The plunger 18 is disposed at least partly in the bore 19 of bobbin 20 for longitudinal reciprocation axially of the bobbin. The plunger 18 is retained captive within the bobbin 20 by means associated with the bobbin, in a manner to be hereinafter described in greater detail. The plunger 18 includes a base portion having a diameter which is only slightly less than that of the diameter of the bore 19 of the bobbin 20 but which permits both longitudinal reciprocation and angular rotation of the plunger relative to the bobbin. Extending longitudinally outward, or upward, from the base portion of plunger 18 is an intermediate spindle portion 30 of lesser diameter, and extending longitudinally outward, or upward, from the intermediate spindle portion 30 is a mounting shaft portion 32 of yet smaller diameter.

The movable contact 16 includes a centrally-positioned circular opening (not shown) through which the plunger mounting shaft portion 32 extends with a small radial clearance therebetween to permit relative longitudinal and angular displacement. The movable contact 16 also includes a pair of small bearing surfaces formed by diametrically opposite upsets 33 on the undersurface thereof. An annular groove is formed in the mounting shaft portion 32 near its end for receiving a conventional retaining clip 34 to limit the range of longitudinal displacement of movable contact 16 relative to the plunger 18. The movable contact 16 is urged toward a limit position relative to the bobbin 20 by appropriate biasing means, such as spring 36. The spring 36 is interposed in compression between the movable contact 16 and the bobbin 20 generally, and between the movable contact 16 and the magnetic frame 24 specifically. The axial distance between the retaining ring 34 and the shoulder formed at the transition between plunger spindle portion 30 and mounting shaft portion 32 is greater than the thickness of the movable contact 16 to create an axially extending gap to allow for overtravel. This gap is intended to accommodate various tolerances and particularly to accommodate for wear of the contacts 12 and the bridge member 16 at their interface.

The plunger 18, the movable contact 16, the spring 36, bobbin 20, coil 22, stop 28, and the magnetic frame 24, 26 comprise an assembly which may be installed as a unit in housing 14. More specifically, the coil assembly comprising bobbin 20 and coil 22 is mounted in the housing 14 in a manner which fixes at least its axial positioning relative to the housing and thus also to the contacts 12. This may be accomplished by a suitable housing end closure (not shown) acting against the magnetic frame base plate 26 and/or a lower flange of the bobbin 20 to urge the coil assembly upward into limiting engagement with a shoulder 40 formed in the housing 14, as seen in FIG. 1.

In the provision of a bistable solenoid switch, it is necessary upon alternate terminations of the coil 22, that the movable contact 16 be respectively in engagement and out of engagement with the contacts 12. To attain that end, there is provided a detenting arrangement in accordance with the invention which, on alternate terminations of energization of coil 22, prevents the spring-biased movable contact 16 from being carried by plunger 18 to a position in engagement with the contacts 12. The detenting arrangement is effective following termination of alternate energizations of the coil because the plunger 18 is caused to rotate in stepwise fashion within bobbin 20 each time it is axially displaced. The rotary stepping and detenting mechanisms of the invention will now be described in greater detail.

As depicted in FIGS. 1–4, the upper end face of stop member 28 is in opposed facing relation with the lower end face of plunger 18. The upper end face of stop member 28 includes a circular array of triangular teeth 50. Similarly, the lower end face of plunger 18 includes a circular array of triangular teeth 52 radially positioned in registry with teeth 50. Teeth 50 and 52 are substantially of the same size, shape and symmetrical pitch, however, it will be remembered that stop member 28 is fixed against rotation whereas plunger 18 is capable of rotation within the bore of bobbin 20. The sloping surfaces defining each of the teeth 50 and 52 represent cam surfaces and/or cam followers. Thus, assuming at least some small angular misalignment between the opposed peaks of teeth 50 and 52, when plunger 18 is moved into contact with stop member 28, the teeth 52 of the plunger will be caused to follow the inclined cam surfaces of teeth 50 of stop member 28 and will thereby impart angular displacement or rotation to the plunger.

At an oppositely-disposed, or upwardly facing, end face of plunger 18, there is provided further means for imparting rotation to the plunger and for providing a complementary portion of the aforementioned detenting arrangement. Specifically, at the end face created by the radial transition between the largest diameter portion of the plunger 18 and the intermediate diameter spindle portion 30, there is provided an annular array of teeth and/or notches which provide further cam surfaces for imparting further rotation to the plunger and which also create lands to limit the plunger's axial displacement. The tooth geometry at the upper end face of plunger 18 differs because the teeth alternate between first and second different geometries. Referring to FIG. 5, that array includes a set of teeth 60 arranged in alternation with a set of teeth 62. Teeth 60 are formed by an axially extending surface **60*a* at their rightward extent and by a second surface 60*b* which is planar and which extends from the axially upper or outermost end of surface 60*a* and is inclined axially downward and inward to the left. Teeth 62 are formed by an axially extending surface 62*a* at their rightward extent, an intermediate planar surface 62*b* extending leftward from the axially uppermost end of surface 62*a* and being inclined axially inward or downward, and an axially downward extending planar surface 62*c* at the leftward extent of the tooth. An axially facing planar surface or land 63 extends leftward from tooth 62 to tooth 60 between the axially inner ends of planar surfaces 62*c* and 60*a***, respectively.

Further in accordance with the invention, one or more projections extend radially into the bore 19 of bobbin 20 from the wall thereof. In the illustrated embodiment, a pair of projections **70*f* and 70*r* are integrally formed in the molded plastic bobbin 20 and extend radially into the bore of the bobbin in diametrically opposed relation at the axially uppermost end of the bobbin. Although both projections 70*f* and 70*r* may be seen in FIGS. 4 and 6–8, only projection 70*f* is depicted in the remaining Figures. Teeth 60 and 62, as well as land 63, are of such angular extent that there are four of each in the annular array of which they are part. Because projections 70*f* and 70*r* are diametrically opposed on the bobbin 20, both projections will be acting on identical diametrically opposed features of the teeth of the plunger at the same time. Thus, reference will only be made to the projection 70*f*** in the following discussion.

Projection **70*f* may be provided with an angularly-short, axially facing surface at its axially-innermost end and from which a planar surface 70*f'* extends rightward in an axially upward or outward inclined direction. The angular width of projection 70*f* is slightly less than the angular width of land 63**.

The angular spacing from tooth surface **60*a* to tooth surface 62*a* via surface 60*b* is substantially the same as from surface 62*a* to surface 60*a* via surface 62*b* and land 63. Further, the angle of incline of surfaces 60*b* and 62*b* are substantially the same, however, surface 62*b* is substantially shorter than 60*b* in order to accommodate the additional angular width of land 63. The inclined surface 70*f'* on projection 70*f* is here illustrated as being steeper than the inclined surfaces 60*b* and 62*b* on plunger 18 to reduce friction, however, if an increase in friction is acceptable in return for longer wear life, surface 70*f'* might be more nearly parallel to surface 60*b* and 62*b***.

Figure 6:
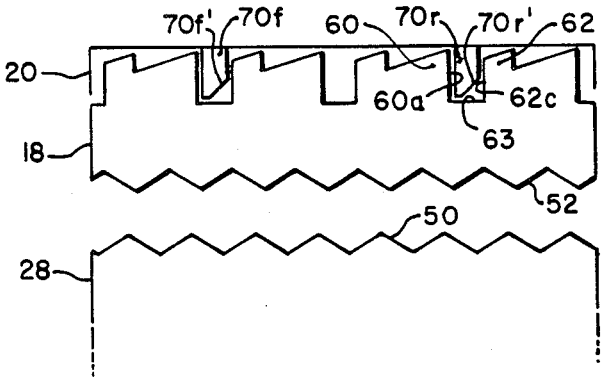
FIGS. 6, 7, and 8 are diagrammatic drawings of the plunger, bobbin projections and stop member of the solenoid switch illustrating the sequential operation thereof.

Referring to FIGS. 1–3 and 6–8, the interaction between projection **70*f* and the contoured upper end face of plunger 18 will be described in greater detail. In FIGS. 1 and 6, the coil 22 is de-energized, the spring 36 has moved the movable contact 16 toward engagement with the contacts 12 and the plunger 18 has been allowed to move axially a sufficient distance to permit actual engagement between movable contact 16 and the contacts 12. That positioning of the plunger 18, and thus also of movable contact 16, is possible only if the plunger 18 is in an angular position which allows it to move relatively upward a maximum distance relative to the projection 70*f*. This occurs only when the slot defined by axial surfaces 62*c* and 60*a* are aligned with the slightly narrower projection 70*f*. The axial depth of that slot to its land 63 is requisite to allow the relative axial displacement. In this position, it should also be noted that the peaks of the teeth 52 at the lower end of plunger 18 are slightly misaligned to the right of the peaks of the teeth 50 of stop 28**.

Figure 7:
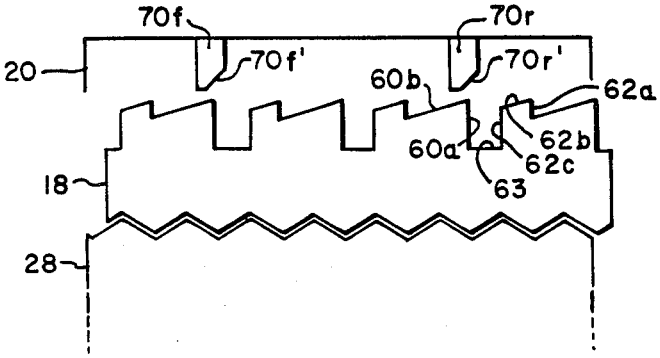

Next, when the coil 22 is energized as depicted in FIGS. 2 and 7, the plunger 18 is magnetically drawn downward into the core of bobbin 20 against the bias force of spring 36. As plunger 1 is drawn into bobbin 20, there is little or no torsional force applied to the plunger as it moves axially downward away from projection **70*f*. Further, while projection 70*f* remains in the slot between teeth 60 and 62, the teeth will inhibit rotation of plunger 18. The projection 70*f* will clear the teeth 60 and 62 at the upper end face of plunger 18 before the teeth 52 at its lower end make contact with teeth 50 of stop 28. When the latter does occur, the plunger 18 will then be caused to rotate relatively rightward because of the misalignment between opposing teeth. The downward axial displacement of plunger 18, and thus also its rightward angular displacement, continue until teeth 52 and 50 completely mesh at the lower limit position, as depicted in FIGS. 2 and 7. In this lower limit position, the movable contact 16 is at its maximum spacing from the fixed contacts 12 and the plunger 18 is displaced axially downward a maximum from the bobbin projections 70***f* and 70*r*. This position remains only so long as current is applied to the coil 22, which in accordance with the desired operation of a bistable solenoid switch, is a relatively short interval.

Figure 8:
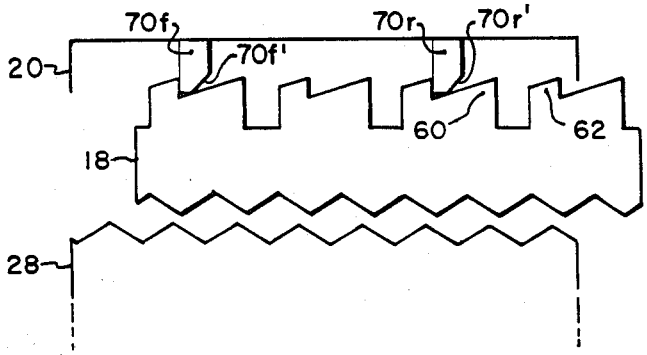

Upon termination of the energization of coil 22, the spring 36 urges movable contact 16 and plunger 18 toward the "Contacts Closed" position of FIGS. 1 and 6, however, projection 70*f* (and 70*r*) interacts with the upper end face of plunger 18 to prevent the attainment of that position. Rather, as plunger 18 moves relatively upward, the axially-lowermost end of projection 70*f* (and 70*r*) will engage the cam surface 60*b* toward its uppermost end and, as the plunger continues to move upward, impart a rightward rotation to the plunger. Because cam surface 60*b* continues to the axially extending surface 62*a* without the interruption of an abrupt axial notch as associated with tooth 62, the relative axial "penetration" of projection 70*f* is limited. More specifically, when the leftward edge of projection 70*f* abuts the rightwardly facing surface 62*a*, the underlying axial support provided by surface 60*b* serves as a land to prevent further axial displacement of the plunger 18 toward the fixed contacts 12. The axial "depth" of the land formed by surface 60*b* when projection 70*f* moves to its limit position is shallow enough to ensure that the movable contact 16, which is urged against the retainer 34 on plunger 18, is clearly out of engagement with the fixed contacts 12. This position is designated as "Contacts Open", as depicted in FIGS. 3 and 8. As in the other stable state, i.e. "Contacts Closed" depicted in FIGS. 1 and 6, the peaks of the teeth 52 are slightly misaligned rightward of the peaks of the teeth 50 on stop member 28. This prepares plunger 18 for further rightward rotation when the coil 22 is next energized preparatory to placing the solenoid switch 10 in the "Contacts Closed" state.

To attain the "Contacts Closed" state depicted in FIGS. 1 and 6, the coil 22 is energized, drawing the lower teeth 52 of plunger 18 into camming engagement with teeth 50 of stop 28. This serves to rotate plunger 18 rightward such that surface 62*b* of tooth 62 on the upper end face is aligned with the projection 70*f*. When energization of coil 22 terminates, spring 36 displaces plunger 18 upward and the camming action between projection 70*f* and surface 62*b* causes further rightward rotation of the plunger until the projection moves into alignment with the slot defined by sidewalls 62*c* and 60*a*, where upon the plunger moves fully upward to the "Contacts Closed" position of FIGS. 1 and 6.

The plunger 18 is formed of a magnetic material as preferably also is the stop 20. While the annular array of teeth on the respective end faces of plunger 18 and the end face stop 28 might be provided by machining, it has been found particularly convenient in accordance with the invention to form plunger 18 and stop 28 of suitable powdered metal such that the geometry of those elements is obtained simply and economically via known molding processes.

It should also be noted that the geometry of solenoid switch housing 14 in the region of movable contact 16 is such that the movable contact is permitted only very limited rotation relative to the housing. This is seen most clearly in FIG. 4 where it will be appreciated that the length of the movable contact 16, as required to span the two fixed contacts 12, is permitted very little angular freedom before contacting the walls of housing 14. This ensures that the appropriate contact surfaces of the movable contact 16 remain in operative alignment with the fixed contacts 12.

Although the invention has been described in relation to a particular embodiment it is to be understood by those skilled in the art that variations and modifications can be made within the spirit and scope of the invention. For instance, although the solenoid switch is described as having two stationary contacts, it will be appreciated that more such contacts may exist, typically in multiples of two. Further, although the movable contact is illustrated as being relatively long and narrow, and its angular displacement relative to the stationary contacts must be restricted, it would be possible to have a movable contact of annular or disc shape for which restriction of such relative angular displacement would not be necessary.

I claim:

1. An improved solenoid-operated bistable switch including two contacts, a coil assembly fixedly positioned relative to said two contacts and including a bobbin having an axial bore and a coil disposed on the bobbin, a plunger disposed at least partly in the bore of the bobbin for rotation and axial reciprocation relative to the bobbin, conductive contact-bridging means mounted on said plunger for reciprocation therewith between at least two positions respectively in and out of contact-bridging engagement with said two contacts, said contact-bridging means being biased toward one of said at least two positions, said coil being selectively energizable to overcome said bias for displacing said plunger and contact-bridging means, the improvement comprising:

means for translating axial displacement of the plunger into rotation of the plunger relative to the bobbin;

said plunger having a first end face, said first end face facing in the direction toward which said contact-bridging means is biased; and detent means cooperatively including radial projection means on said bobbin and first land means extending less than 360° on said first end face of the plunger, said detent means preventing displacement of said plunger and contact-bridging means entirely to said position toward which they are biased when energization of the coil is terminated and said first land means is angularly in registry with said projection means.

2. The solenoid-operated bistable switch of claim 1 wherein said detent means and said means for translating axial displacement of the plunger to said rotational displacement thereof are cooperatively structured to provide said registry between said first land means and said projection means following alternate terminations of energization of the coil.

3. The solenoid-operated bistable switch of claim 2 wherein said means for translating axial displacement of the plunger into said rotation relative to said bobbin comprises first and second axial-to-rotary displacement translation means for providing said rotation upon axial displacement of said plunger in respectively opposite directions.

4. The solenoid-operated bistable switch of claim 3 wherein said first axial-to-rotary displacement translation means comprises said plunger first end face including at least one cam surface positioned for axial engagement with said bobbin projection and contoured to impart relative angular displacement to the plunger when moved axially toward one another.

5. The solenoid-operated bistable switch of claim 4 wherein said second axial-to-rotary displacement translation means comprises said plunger having a second end face and a fixed stop member in axial alignment with said plunger second end face, said plunger second end face being oppositely disposed with regard to said plunger first end face, and said stop member and said plunger second end face being configured to provide a complementary cam surface and follower.

6. The solenoid-operated bistable switch of claim 5 wherein said stop member and said plunger second end face include respective circular arrays of triangular teeth in facing relation to thereby provide said complementary cam surface and follower.

7. The solenoid-operated bistable switch of claim 4 wherein said first axial-to-rotary displacement translation means comprises said plunger first end face having first and second cam surfaces in angular-sequential relation, said bobbin projection alternately engaging and moving along said first and said second cam surfaces following respective alternate terminations of energization of the coil, said first cam means having a leading and a trailing end and said first land means being proximate said trailing end of said first cam means.

8. The solenoid-operated bistable switch of claim 7 wherein said plunger first end face further includes second land means angularly spaced from said first land means, said second cam surface having a leading and a trailing end, said second land means being proximate said trailing end of said second cam surface and wherein said second land means is so positioned axially of the plunger that displacement of said plunger and contact-bridging means to said position toward which they are biased is permitted when said second land means is rotated into registry with said projection means.

9. The solenoid-operated bistable switch of claim 8 wherein each of said first and second cam surfaces is inclined in the same general direction to effect unidirectional rotation of the plunger.

10. The solenoid-operated bistable switch of claim 9 wherein said first cam surface and said first land means comprise a single first inclined plane, and said second cam surface and said second land means comprise, in combination, a second inclined plane and a stepped-notch extending axially inward of the plunger.

11. The solenoid-operated bistable switch of claim 2 wherein said contact-bridging means is mounted on said plunger to allow limited axial displacement relative thereto and including biasing means acting directly on said contact-bridging means for urging said contact-bridging means toward said one of said at least two positions.

12. The solenoid-operated bistable switch of claim 11 wherein said one position toward which said contact-bridging means is urged is said position in contact-bridging engagement with said two contacts.

13. The solenoid-operated bistable switch of claim 10 wherein said contact-bridging means is mounted on said plunger to allow limited axial displacement relative thereto and including biasing means acting directly on said contact-bridging means for urging said contact-bridging means toward said one of said at least two positions.

14. The solenoid-operated bistable switch of claim 10 wherein said radial projection means extends radially into the bore of the bobbin and includes an inclined planar surface in approximate facing relation with said first and second inclined planes of said first and second cam surfaces.

15. The solenoid-operated bistable switch of claim 14 wherein said bobbin is plastic and said radial projection means is integrally molded therewith.

16. The solenoid-operated bistable switch of claim 4 wherein said contact-bridging means is mounted on said plunger in a manner affording relative rotation therebetween.

* * * * *